US010994874B2

(12) United States Patent
Franzen et al.

(10) Patent No.: US 10,994,874 B2
(45) Date of Patent: May 4, 2021

(54) METHOD AND APPARATUS FOR PACKAGING SMOKING ARTICLES

(71) Applicant: JT International S.A., Geneva (CH)

(72) Inventors: Jens Franzen, Hentern (DE); Franz-Josef Tritz, Palzem (DE)

(73) Assignee: JT International S.A.

( * ) Notice: Subject to any disclaimer, the term of this patent is extended or adjusted under 35 U.S.C. 154(b) by 337 days.

(21) Appl. No.: 16/316,222

(22) PCT Filed: Sep. 29, 2017

(86) PCT No.: PCT/EP2017/074793
§ 371 (c)(1),
(2) Date: Jan. 8, 2019

(87) PCT Pub. No.: WO2018/060434
PCT Pub. Date: Apr. 5, 2018

(65) Prior Publication Data

US 2019/0161222 A1 May 30, 2019

(30) Foreign Application Priority Data

Sep. 30, 2016 (EP) ..... 16191976

(51) Int. Cl.
*B65B 19/28* (2006.01)
*B65B 19/02* (2006.01)
(Continued)

(52) U.S. Cl.
CPC ..... *B65B 19/28* (2013.01); *B65B 7/26* (2013.01); *B65B 19/025* (2013.01); *B65B 43/38* (2013.01);
(Continued)

(58) Field of Classification Search
CPC ..... B65B 19/025; B65B 19/20; B65B 19/28; B65B 51/023; B65B 51/067; B65B 51/10;
(Continued)

(56) References Cited

U.S. PATENT DOCUMENTS 4,300,676 A * 11/1981 Focke ..... B65D 75/5838 206/264
4,557,101 A * 12/1985 Hesterberg ..... B65B 19/20 453/49
(Continued)

FOREIGN PATENT DOCUMENTS

DE 3413828 A1 10/1985
EP 2366637 A1 9/2011
(Continued)

OTHER PUBLICATIONS

International Search Report for PCT/EP2017/074793 (published as WO2018/060434) dated Nov. 8, 2017.

*Primary Examiner* — Valentin Neacsu
(74) *Attorney, Agent, or Firm* — Lerner, David, Littenberg, Krumholz & Mentlik, LLP

(57) ABSTRACT

A method of producing a pack of smoking articles includes providing a pre-assembled pack of smoking articles comprising an inner pack having a flexible sheet in which a group of smoking articles is wrapped or enclosed and a re-closable flap movable between a closed position preventing access to the smoking articles and an open position for accessing the smoking articles, and an outer pack comprising a container which holds and substantially encompasses the inner pack, the outer pack having a lid in a closed position preventing access to the inner pack; creating a space or gap between the lid of the outer pack and the inner pack; and attaching the re-closable flap of the inner pack to the lid of the outer pack via and/or through the space or gap. An
(Continued)

apparatus for producing a pack of smoking articles per the above method is also provided.

13 Claims, 3 Drawing Sheets

(51) Int. Cl.

| | |
|---|---|
| ***B65B 51/10*** | (2006.01) |
| ***B65D 85/10*** | (2006.01) |
| ***B65B 51/02*** | (2006.01) |
| ***B65B 51/06*** | (2006.01) |
| ***B65B 61/20*** | (2006.01) |
| ***B65B 43/38*** | (2006.01) |
| ***B65B 7/26*** | (2006.01) |
| ***B65B 57/08*** | (2006.01) |
| ***B65B 57/02*** | (2006.01) |
| *B65B 19/20* | (2006.01) |

(52) U.S. Cl.
CPC ..... *B65B 51/023* (2013.01); *B65B 51/067* (2013.01); *B65B 51/10* (2013.01); *B65B 57/02* (2013.01); *B65B 57/08* (2013.01); *B65B 61/20* (2013.01); *B65D 85/1027* (2013.01); *B65D 85/10568* (2020.05); *B65B 19/20* (2013.01); *B65B 2230/04* (2013.01)

(58) Field of Classification Search
CPC ..... B65D 85/1027; B65D 85/1045; B65D 85/1054; B65D 85/10568
USPC ..... 53/136.1, 136.3, 136.4, 461, 50, 412, 53/415–416; 206/242, 261, 264, 265, 268
See application file for complete search history.

(56) References Cited

U.S. PATENT DOCUMENTS

| | | | | |
|---|---|---|---|---|
| 10,077,132 | B2 * | 9/2018 | Bellamah | B65D 85/10568 |
| 10,077,151 | B2 * | 9/2018 | Bellamah | B65D 85/10568 |
| 10,086,987 | B2 * | 10/2018 | Bellamah | B65D 75/68 |
| 10,266,335 | B2 * | 4/2019 | Krasiev | B65D 75/5833 |
| 2012/0006823 | A1 * | 1/2012 | Bertuzzi | B65D 85/1027 220/270 |
| 2014/0110286 | A1 * | 4/2014 | Bertuzzi | A24F 15/12 206/268 |
| 2017/0203910 | A1 * | 7/2017 | Buse | B65D 77/38 |
| 2017/0275082 | A1 * | 9/2017 | Krasiev | B65D 85/10568 |
| 2017/0327303 | A1 * | 11/2017 | Krasiev | B65D 5/0281 |
| 2018/0339846 | A1 * | 11/2018 | Eggen | B65D 75/5838 |

FOREIGN PATENT DOCUMENTS

| | | | |
|---|---|---|---|
| EP | 2155568 | B1 | 7/2012 |
| EP | 2944575 | A1 | 11/2015 |
| WO | 2016102461 | A1 | 6/2016 |

* cited by examiner

METHOD AND APPARATUS FOR PACKAGING SMOKING ARTICLES

CROSS-REFERENCE TO RELATED APPLICATIONS

The present application is a national phase entry under 35 U.S.C. § 371 of International Application No. PCT/EP2017/074793, filed Sep. 29, 2017, published in English, which claims priority to European Application No. 16191976.6 filed Sep. 30, 2016, the disclosures of which are incorporated herein by reference.

BACKGROUND OF THE INVENTION

The present invention concerns packaging of smoking articles, such as cigarettes, cigarillos, cigars, and the like, which for the sake of brevity and clarity, will simply be referred to herein as "smoking articles". In particular, the invention relates to a method and apparatus for packaging smoking articles, and to a pack of smoking articles produced by such a method and apparatus.

It is known to overwrap packs of smoking articles to seal them from exposure to the environment to limit both ingress and egress of moisture, and to preserve or maintain flavour. A known manner of preserving the contents of a pack of smoking articles is to overwrap the pack in cellophane. This results in a sealed pack with a longer shelf life. After removing the cellophane to open the pack, however, the smoking articles are exposed to the environment and the same issues relating to moisture and flavour still arise, especially in hot and dry or humid environments.

In an attempt to address these issues, rigid packs have been proposed in which the smoking articles are wrapped with an airtight material which has an extraction opening that is closed by a reusable cover flap to provide access to the smoking articles. The cover flap may be repeatedly secured to close the extraction opening; for example, via a tacky adhesive provided on the cover flap and/or around the extraction opening.

Two types of such packs are known. In a first type, the consumer firstly needs to open the pack lid to gain access to the wrapped bundle of smoking articles, and secondly, to open the cover flap to gain access to the smoking articles. To reclose the pack, the consumer then needs to close the cover flap, and thereafter to close the lid. Such a pack is known, for example, from U.S. Pat. No. 4,300,676 A.

In a more recent, second type, the cover flap is permanently attached to the lid of the pack such that when the consumer opens a lid of the pack, the cover flap moves in unison with the lid and provides access to the smoking articles. To close the pack, closure of the lid causes the cover flap to cover the extraction opening without the consumer having to manually position the cover flap back over it. Such a pack is known from, for example, EP 2 155 568 B1.

Although there is an industry trend towards the more recent second type of pack, some consumers prefer packs which allow then to close the cover flap over the extraction opening manually. Accordingly, there is demand for both pack types and these may co-exist in the market.

To date, the production of such packs has required a significant investment in packaging production line equipment. That is, in markets where the production of both types of packs is desired, packaging production line equipment for each type of pack is necessary, which also has a significant impact on the area required (i.e. footprint) at the factory.

In view of the above, it would be desirable to provide a new and improved method and apparatus for packaging smoking articles of the type having a re-closable flap that moves together or in unison with the pack's lid.

BRIEF SUMMARY OF THE INVENTION

In accordance with this invention, a method of packaging smoking articles having the features as recited in claim 1, and an apparatus for packaging smoking articles having the features as recited in claim 11 is provided. Various preferred and/or advantageous features of the invention are recited in the dependent claims.

According to one aspect, therefore, the invention provides a method of producing a pack of smoking articles, comprising:

- providing a pre-assembled pack of smoking articles, the pre-assembled pack comprising an inner pack of a group of smoking articles wrapped or enclosed in a flexible sheet and having a re-closable flap that is movable between a closed position for preventing access to the smoking articles and an open position for accessing the smoking articles; and an outer pack comprising a container which holds and substantially encompasses the inner pack and a lid in a closed position for preventing access to the inner pack, wherein the lid is movable between the closed position and an open position for accessing the inner pack;
- creating a space or gap between the lid of the outer pack and the flexible sheet of the inner pack to provide access to a portion of the re-closable flap;
- attaching the re-closable flap of the inner pack to the lid of the outer pack through or via the space or gap; and
- subsequently, transporting the pack to a wrapping station to wrap the pack individually in a clear film.

In this way, the present invention is able to provide a wrapped pack of smoking articles in which the re-closable flap of the inner pack is attached to or interconnected with the lid of the outer pack for movement therewith between the closed and open positions. Moreover, the present invention provides a highly efficient and economical manner of achieving such a final pack configuration. In particular, although the resultant pack configuration is ultimately quite different and includes an attachment or interconnection of the flap and the lid, existing infrastructure and equipment can continue to be used. That is, the inventors have developed techniques with which a pre-assembled pack having an outer rigid pack with the re-closable lid in a closed position can be manipulated to create a space or gap between the lid of the outer pack and the flexible sheet of the inner pack that provides access to a portion of the re-closable flap which is sufficient to effect an attachment between the flap and the lid, such that they can be moved in unison between the closed and open positions.

Another advantage of the present invention is that it allows a reduced footprint for those factories where there is a desire to also produce packs where the flap is not attached to the lid. That is, the production line for such packs produces the starting product for the method of the present invention. Conveyor means may be provided to adapt the process steps used to attach the flap to the lid to that purpose. This provides for a more flexible manufacturing site with a reduced footprint.

The step of attaching the flap of the inner pack to the lid of the outer pack for movement together between the closed position and open position may comprise introducing attaching means into the space or gap for attaching the flap to the lid. In this regard, the attaching means, such as an adhesive means, is introduced into the space or gap for contact with the re-closable flap of the inner pack and/or with the lid of the outer pack. The space or gap is typically provided between an inner surface of the lid of the outer pack, especially a lower edge of the lid of the outer pack, and an outer surface of the inner pack, especially a front panel of the container of the outer pack. The space or gap may measure less than about 8 mm; for example, less than about 6 mm or, for example, in the range of about 2 mm to about 6 mm.

The inventors have observed that limiting the space created between the lid of the outer pack and the inner pack allows performing the attachment step without degrading the appearance of the pack. In other words, such range will prevent a used look on the pack and maintain a pristine appearance.

The step of introducing the attaching means may comprise applying an adhesive means onto the re-closable lid of the outer pack, and/or onto the re-closable flap of the inner pack. In one example, the adhesive is applied onto an inner surface of the lid and/or onto an outer surface of the flap. The adhesive means may comprise at least one of: an adhesive medium or element, such as a double-sided adhesive element (e.g. double-sided adhesive strip), and an adhesive in fluid state. The adhesive in fluid state may be applied in spots, or stripes. Alternatively, the adhesive in fluid state may be applied in to cover a region or area of the flap and/or lid, e.g. substantially uninterrupted.

The adhesive means may comprise at least one of: a drying adhesive, such as a water-based or a solvent-based adhesive, a pressure-sensitive adhesive, such as PVA, and a hot-melt adhesive. One or more combinations of different types of adhesives may be advantageous to obtain a high yield while ensuring a proper attachment of the flap to the lid at high speed. Especially advantageous is to provide a combination of hot-melt adhesive, which provides an almost immediate bond between the flap and the lid, but is costly, and a drying adhesive or a pressure-sensitive adhesive, which do not provide an immediate bonding between the flap and the lid as they require an extra step for effective bonding (i.e. drying adhesives need to dry and pressure-sensitive adhesives require pressure application). By providing such a combination of adhesives, an immediate bonding of the flap to the lid may be obtained at a reduced cost, as one spot of hot-melt will suffice to ensure correct positioning and provide the extra time required for the other type of adhesive to effectively bond the flap to the lid to the target or required bonding strength.

In another embodiment, the step of introducing attaching means may include introducing heat onto a region of the lid of the outer pack and/or onto a region of the re-closable flap of the inner pack. This way, a heat-sensitive medium or material provided at this region may soften or melt to effect a fusion or bond after heating. The heat may, for example, be introduced by directing a laser beam through the space or gap created.

In a further embodiment, the step of creating the space or gap between the lid of the outer pack and the inner pack comprises moving the lid of the outer pack relative to the container, and/or moving the container relative to the re-closable lid of the outer pack. More particularly, the lid of the outer pack may be moved (relatively) from the closed position to an at least partially open position so as to create the space or gap between the lid and the inner pack through or via which the flap of the inner pack and the lid of the outer pack are attached to one another. Preferably, the lid is rotated from the closed position to a partially open position in which a top portion of the inner pack is not exposed. In the past it has generally been considered undesirable to open a lid of an outer pack after assembly, as this has typically degraded the appearance of the pack and given it a "used" look. The inventors have determined, however, that by limiting the degree to which the lid of the outer pack is opened, the deleterious effects of the opening operation can be substantially avoided. Furthermore, the inventors have determined that even a limited opening of the lid is sufficient to provide an effective attachment between the re-closable flap of the inner pack and the lid of the outer pack, such that they can move in unison between the closed and open positions. Thus, the invention represents a major development in simplifying the production of such a desirable pack configuration.

In an embodiment, the lid of the outer pack is pivotally connected to the container of the outer pack, usually via a hinge-type connection. In this way, the lid is configured for pivoting or rotational movement between the closed position and the open position. The step of creating the space or gap between the lid of the outer pack and the inner pack may therefore comprise pivoting or rotating the lid of the outer pack relative to the container through an angle of less than about 35°, for example of less than about 30°, for example of less than about 25°. By limiting relative rotation of the lid to these angles, it is possible to avoid the deleterious effects of the opening operation. The step of creating the space or gap between the lid of the outer pack and the inner pack may comprise pivoting or rotating the lid of the outer pack relative to the container through an angle of at least about 15°, for example, of at least about 20°, or for example, in a range of between about 20° and 30°. The inventors have determined that a relative lid rotation in these ranges results in a higher manufacturing speed, especially when the step of attaching the re-closable flap of the inner pack to the lid of the outer pack through or via the space or gap comprises applying an adhesive means onto the re-closable lid of the outer pack, and/or onto the re-closable flap of the inner pack.

In an alternative embodiment, the step of creating the space or gap between the lid of the outer pack and the inner pack comprises deforming the outer pack and/or the inner pack to cause a space or gap between the lid and the flap, for example, by application of a compression force. In this regard, it will be appreciated that such deformation of the outer pack need only be relatively slight and may still be sufficient to introduce the attaching means. In one example, deformation of the outer pack comprises buckling or bulging the lid of the outer pack, especially a front panel of the lid of the outer pack, for example, by the application of a lateral compressive force. A slight curvature of the front panel of the lid may still be sufficient to introduce the attaching means, as described above. In another example, deformation of the outer pack comprises compressing the container of the outer pack, especially a front panel of the container of the outer pack. In another example, both the lid of the outer pack and the container of the outer pack are deformed.

In another embodiment, the step of creating the space or gap between the lid of the outer pack and the inner pack may comprise employing a tool or inserting a tool between the lid of the outer pack and the inner pack to form the space or gap. In this regard, the tool may cause the above deformation of the outer pack, be it a deformation of the lid, the container, or both. The same tool, or another, may then be used to introduce or insert the attaching means into that space or gap.

The pack may comprise a stiffener arranged within the outer pack partly enclosing the inner pack or within the inner pack partly enclosing the group of smoking articles. The stiffener may be arranged to prevent damaging the smoking articles due to pressure exerted on the outer pack to create a space or gap between the inner pack and the lid. By providing such a stiffener, a larger space or gap may be created between the lid and the inner pack through compression of one or more outer pack panels without damaging the smoking articles.

The stiffener may comprise a major panel, and two minor panels connected to the major panel at opposite sides of the major panel. In both cases, the major panel of the stiffener is positioned substantially parallel to the container's front wall and the minor panels surround sides of the inner pack or of the group of smoking articles. The stiffener may comprise further panels or walls, such as a bottom panel that would reinforce a bottom portion of the inner pack or the group of smoking articles, or top panels or shoulders that reinforce a top portion of the inner pack or the group of smoking articles. Irrespective of the number of panels or walls the stiffener may have, the stiffener is preferably shaped to allow access to the smoking articles within the inner pack without further restricting the consumer's accessibility to the pack's contents.

The stiffener is preferably suitable to other embodiments where the space or gap is not created through pressure exertion on one or more panels or walls of the outer pack, as the stiffener increases pack rigidity.

The attaching step may comprise bringing an inner surface of the lid and an outer surface of the re-closable flap closely together, desirably into contact with one another, for example, by applying pressure to the lid. In this way, the attaching means introduced via the space or gap can be brought into intimate bonding contact with both the flap and the lid to effect a permanent and non-removable attachment between them.

The attaching step may comprise bringing an inner surface of the lid and an outer surface of the re-closable flap closely together, desirably into contact with one another, and subsequently maintaining the inner surface of the lid and the outer surface of the re-closable flap closely together, desirably in contact with one another, for at least a predetermined period of time. When pressure is applied to the lid for this purpose, the applied pressure is preferably maintained for at least the predetermined period of time.

The step of applying pressure for the predetermined period of time has been found particularly advantageous in embodiments where the step of attaching the re-closable flap of the inner pack to the lid of the outer pack through or via the space or gap comprises applying an adhesive means onto the re-closable lid of the outer pack, and/or onto the re-closable flap of the inner pack.

The predetermined period of time may be of the order of tenths of a second, for example between one and ten tenths of a second, in particular when no adhesive means is used. The inventors have discovered that in embodiments in which an adhesive in fluid state is used, the predetermined period of time is advantageously in the range of about 3 s to about 6 s, for example, the predetermined period of time may be of about 5 s. It has been found that, when a PVA adhesive is used, maintaining the applied pressure for a minimum of about 4 s, specifically for a minimum of about 5 s, is especially preferred for creating an adequate bonding of the flap and the lid.

The method may further include moving the lid of the outer pack back to the closed position after introducing the attaching means. In this way, the attaching means may be pressed into contact with either or both an outer surface of the re-closable flap of the inner pack and an inner surface of the lid of the outer pack, thereby bringing the attaching means (e.g. adhesive means) into intimate bonding contact with both the flap and the lid to effect a non-removable attachment between them.

The method may further comprise: detecting application of the adhesive means to the lid of the outer pack and/or to the flap of the inner pack; and rejecting the pack if application of the adhesive means is detected as having failed. The application of the adhesive means is typically detected as having failed if no adhesive means is detected, or if an amount or a location of the adhesive means is detected as incorrect. In some embodiments the steps of adhesive means application failure detection and pack rejection are consecutive. However, in other embodiments one or more intermediate steps are performed between the detection and the rejection steps. In such case, the defective pack is referenced and rejected after the one or more intermediate steps are performed.

In embodiments in which the attaching step comprises bringing an inner surface of the lid and an outer surface of the re-closable flap closely together, desirably into contact with one another, the step of detecting application of the adhesive means to the lid of the outer pack and/or to the flap of the inner pack is preferably conducted before the inner surface of the lid and the outer surface of the re-closable flap are brought closely together, desirably into contact with one another. The step of rejecting the pack if application of the adhesive means is detected as having failed is preferably conducted after the step of bringing the inner surface of the lid and the outer surface of the re-closable flap closely together, desirably into contact with one another.

According to another aspect, the invention provides an apparatus for producing a pack of smoking articles, comprising:

- a receiving unit for receiving a pre-assembled pack of smoking articles comprising an inner pack comprised of a group of smoking articles wrapped or enclosed in a flexible sheet having a re-closable flap which is movable between a closed position preventing access to the smoking articles and an open position for accessing the smoking articles, and an outer pack comprising a container which holds and substantially encompasses the inner pack, wherein the outer pack has a lid in a closed position for preventing access to the inner pack;
- an attaching unit for creating a space or gap between the re-closable lid of the outer pack and the inner pack and for introducing attaching means through the space or gap for attaching the re-closable flap of the inner pack to the lid of the outer pack.

The attaching unit may be configured to introduce or apply the attaching means, especially in the form of an adhesive medium, onto an outer surface of the flap of the inner pack and/or onto an inner surface of the lid of the outer pack via the space or gap. The adhesive medium may preferably comprise an adhesive strip or an adhesive in fluid state.

In one embodiment, the attaching unit is configured to move the lid of the outer pack relative to the container to create the space or gap. In this regard, the attaching unit may be configured to open the lid at least partially relative to the container. This typically involves relatively moving the lid from the closed position to a partially open position. The attaching unit may be further configured to move the lid of the outer pack back to the closed position after introducing the attaching means. This may thereby act to press the attaching means into contact with either or both of an outer surface of the flap of the inner pack and an inner surface of the lid of the outer pack.

In an alternative embodiment, the attaching unit is configured to deform the outer pack, especially a front panel of the lid of the outer pack, for example, by the application of a lateral compressive force.

In another embodiment, the attaching unit comprises a tool for insertion between the lid of the outer pack and the inner pack to form the space or gap. In this regard, the tool may cause a slight inward curvature of the container of the outer pack, especially of a front panel of the container of the outer pack, and/or a slight outward curvature of the lid of the outer pack, especially of the front panel of the lid of the outer pack. The same tool, or another, may then be used to introduce or insert the attaching means into that space or gap.

The attaching unit may be configured to bring an inner surface of the lid and an outer surface of the re-closable flap closely together, desirably into contact with one another, and subsequently maintain the inner surface of the lid and the outer surface of the re-closable flap closely together, desirably in contact with one another, for at least a predetermined period of time.

The predetermined period of time may be of the order of tenths of a second, for example between one and ten tenths of a second, in particular when no adhesive means is used. The inventors have discovered that in embodiments in which an adhesive in fluid state is used, the predetermined period of time is advantageously in the range of about 3 s to about 6 s, for example, the predetermined period of time may be of about 5 s.

The apparatus may further comprise a sensor for detecting an application of the attaching means to the lid of the outer pack and/or to the flap of the inner pack, and a sorting mechanism for rejecting the pack if the application of the attaching means is detected as having failed. As noted above, application of the attaching means is typically detected as having failed if no attaching means is detected, or if a location or extent of the attaching means is detected as incorrect. The apparatus may include a controller and/or a processor for receiving and analysing data from the sensor and for controlling the operation of the sorting mechanism.

In a preferred embodiment the sensor is or comprises a camera arranged and configured to capture an image of the applied attaching means. The image is sent to a controller and/or a processor where the image is analysed to detect the presence of the attaching means and, optionally, the extent and/or location of the attaching means. If the application of the attaching means is detected as having failed, the pack is rejected by the sorting mechanism.

In certain embodiments of the invention, the apparatus comprises a conveyor arrangement for conveying a completed pack away from the apparatus and towards a wrapping station. The conveyor arrangement is configured to both convey the pack and apply pressure to the lid of the pack for a predetermined period of time. In a preferred embodiment, the conveyor arrangement comprises two conveyor belts that engage opposing pack surfaces such that a pressure is applied to the lid.

The receiving unit of the apparatus may be configured to receive the pre-assembled pack of smoking articles in a particular orientation and, after attaching the re-closable flap of the inner pack to the lid of the outer pack, the attaching unit may be configured to discharge the pack of smoking articles in the same orientation. The orientation may be a lying orientation, with a front side of the pack facing upwards and with the re-closable lid of the outer pack at a forward end in a travel direction received by the receiving unit. Preferably, the apparatus of the invention is configured to receive and to process a plurality of the pre-assembled packs of smoking articles in series. In this way, the apparatus of the invention is able to be added to and to complement an existing packaging production line with relatively minimal disturbance to the existing equipment and infrastructure.

BRIEF DESCRIPTION OF THE DRAWINGS

For a more complete understanding of the invention and the advantages thereof, exemplary embodiments of the invention are explained in more detail in the following description with reference to the accompanying drawing figures, in which like reference characters designate like parts and in which.

DETAILED DESCRIPTION

The accompanying drawings are included to provide a further understanding of the present invention and are incorporated in and constitute a part of this specification. The drawings illustrate particular embodiments of the invention and together with the description serve to explain the principles of the invention. Other embodiments of the invention and many of the attendant advantages of the invention will be readily appreciated as they become better understood with reference to the following detailed description.

It will be appreciated that common and well understood elements that may be useful or necessary in a commercially feasible embodiment are not necessarily depicted in order to facilitate a more abstracted view of the embodiments. The elements of the drawings are not necessarily illustrated to scale relative to each other. It will further be appreciated that certain actions and/or steps in an embodiment of a method may be described or depicted in a particular order of occurrences while those skilled in the art will understand that such specificity with respect to sequence is not actually required. It will also be understood that the terms and expressions used in the present specification have the ordinary meaning as is accorded to such terms and expressions with respect to their corresponding respective areas of inquiry and study, except where specific meanings have otherwise been set forth herein.

Figure 1:
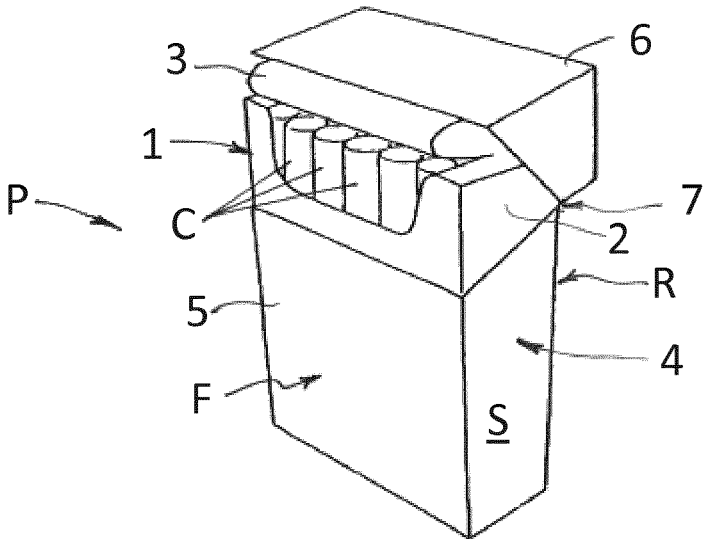
FIG. 1 is a schematic perspective view of a pack of smoking articles that is known from the prior art.

With reference firstly to FIG. 1 of the drawings, a pack P of smoking articles C, e.g. cigarettes, is shown schematically reproduced from drawings of European patent EP 2 155 568 B1. The pack P has a conventional rectangular cuboid configuration with major front and rear panels F, R and smaller side panels S. The pack P is a hybrid pack and comprises a soft inner pack 1 having a flexible sheet 2 of barrier film in which a group or charge of the smoking articles C is wrapped or enclosed and a re-closable flap 3 that is movable between a closed position (not shown) for preventing access to the smoking articles C and an open position (shown) for accessing the smoking articles. The underside of the flap 3 includes a tacky adhesive around a smoking article extraction opening in the inner pack 1 that provides access to the charge of smoking articles C. This allows repeated closure of the flap 3 to the inner pack 1 about the extraction opening. The pack P further includes a rigid outer pack 4 formed of card and comprising a container body 5 which holds and substantially encompasses the inner pack 1 and a lid 6. The lid 6 is pivotally hinged to the container body 5 and is movable between a closed position (not shown) and an open position (shown). As may be noticed from FIG. 1, the re-closable flap 3 of the inner pack 1 is firmly attached to the lid 6 of the outer pack 4 for movement therewith between the open and closed positions.

Figure 2:
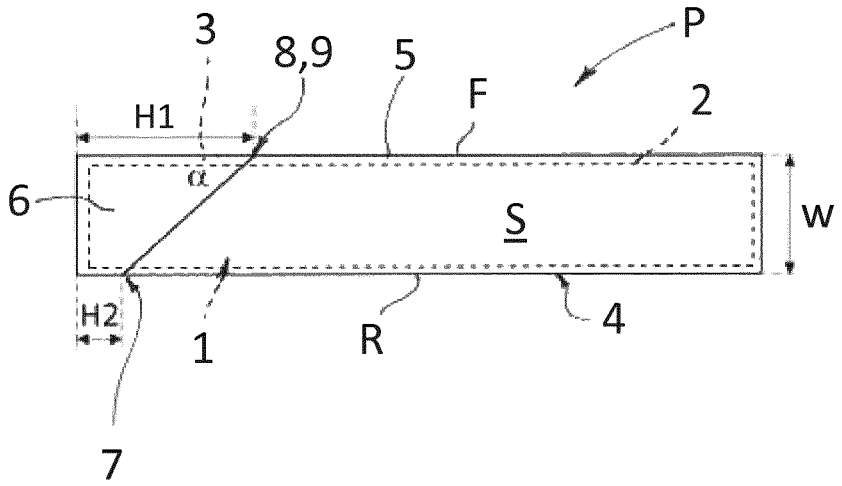
FIG. 2 is a schematic side view of the pre-assembled pack of smoking articles with the lid of the outer pack in a closed state during a method according to a preferred embodiment.
Figure 3:
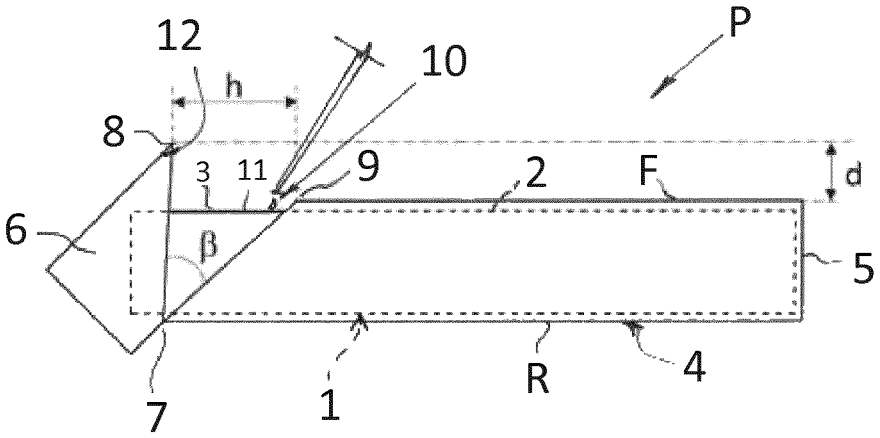
FIG. 3 is a schematic side view of the outer pack of the pack of smoking articles in a partially opened state during a method according to a preferred embodiment.

With reference now to FIGS. 2 and 3 of the drawings, a method of producing such a configuration for a pack P of smoking articles C according to an embodiment will be described. A pre-assembled pack P of smoking articles C as shown in FIG. 2 is provided. The pre-assembled pack P again has a conventional rectangular cuboid configuration with major front and rear panels F, R and smaller side panels S. The pre-assembled pack P furthermore again comprises a soft inner pack 1 in which a group or charge of smoking articles C is wrapped or enclosed in a flexible sheet 2 of barrier film and having a re-closable flap 3 that is movable between a closed position (shown) preventing access to the smoking articles C and an open position for accessing the smoking articles (not shown). The pre-assembled pack P further comprises a rigid outer pack 4 essentially defining the rectangular cuboid shape and having a container body 5 which holds and substantially encompasses the inner pack 1 and a lid 6 in a closed position (shown) for preventing access to the inner pack 1. As with the pack P in FIG. 1, the lid 6 is pivotally connected to the container body 5 of the outer pack 4 via a hinge line 7 and is movable between the closed position (shown) and an open position (not shown).

The soft inner pack 1 is represented by the rectangular broken line within the outer pack 4. In this regard, it can be seen that an upper end region of the inner pack 1 is received and covered by the lid 6. Thus, when the lid 6 is pivoted at least partially open by a rotation of the lid 6 relative to the container body 5 about the hinge line 7 (e.g. as seen in FIG. 3), the upper end region of the inner pack 1 including the re-closable flap 3 is exposed for access to the inner pack 1. A pivot angle β for partially opening the lid 6 relative to the container body 5 is no more than 35°, and preferably between about 8° and about 25°. By limiting the degree to which the lid 6 is opened, the pristine appearance of the outer pack 4 can be generally maintained.

Referring further to FIG. 3, the partial opening of the lid 6 of the outer pack P creates a space or gap between the lid 6 of the outer pack and the flexible sheet 2 of the inner pack 1. The space or gap may be considered or measured in different directions. For example, if considering the pack P from above or in a plan view, the space or gap may be represented by a dimension "h" shown in FIG. 3 between a lower edge 8 of the lid 6 and a complementary edge 9 of the container body 5. On the other hand, if considering the pack P from an end view, the space or gap may be represented by a dimension "d" shown in FIG. 3 between the lower edge 8 of the lid 6 and a front panel F of the container body 5. The space or gap h is typically no more than 15 mm, preferably of no more than 12 mm, and more preferably in the range of 4 mm to 8 mm. The space or gap d is typically no more than 8 mm and preferably in the range of 2 mm to 6 mm.

After partially opening the lid 6 of the outer pack 4 by pivoting the lid 6 about the hinge line 7 through the angle β to access the inner pack 1, an adhesive medium 10, such as a hot-melt adhesive may be introduced via the space or gap d for application to an outer surface 11 of the flap 3 of the inner pack 1 and/or to an inner surface 12 of the lid 6 of the outer pack 4. To this end, a nozzle applicator as shown in FIG. 3 may be employed. Alternatively, the adhesive medium 10 could comprise a double-sided adhesive strip to be applied (e.g. by means of applicator tool) through the space or gap h, d for application onto an outer surface 11 of the flap 3 of the inner pack 1 and/or onto an inner surface 12 of the lid 6 of the outer pack 4. Thereafter, the lid 6 is pivoted back to the closed position to bring the inner surface 12 of the lid 6 and the outer surface 11 of the flap 3 close together, e.g. by applying pressure to the lid 6. In this way, the adhesive medium 10 introduced via the space or gap h, d is brought into intimate bonding contact with both the flap 3 and the lid 6 to effect a permanent and non-removable attachment between them. The applied pressure is maintained for a predetermined period of time to ensure a permanent and non-removable attachment.

The predetermined period of time may be of the order of tenths of a second, for example between one and ten tenths of a second, in particular when no adhesive means is used. The inventors have discovered that in embodiments in which an adhesive in fluid state is used, the predetermined period of time is advantageously in the range of about 3 s to about 6 s, for example, the predetermined period of time may be of about 5 s.

It has been found that, when a PVA adhesive is used, maintaining the applied pressure for a minimum of about 4 s, specifically for a minimum of about 5 s, is especially preferred for creating an adequate bonding of the flap and the lid.

A sensor device (not shown) is typically provided for detecting application of the adhesive medium 10 to the lid 6 of the outer pack 4 and/or to the flap 3 of the inner pack 1. Furthermore, a sorting mechanism is also provided for rejecting the pack P if application of the adhesive medium 10 is detected as having failed; that is, if no adhesive medium 10 is detected, or if a location or extent of the adhesive medium 10 is incorrect. A controller and/or processor for receiving and analysing data from the sensor device and for controlling the operation of the sorting mechanism may also be provided.

The sensor device is, or comprises, preferably a camera configured to obtain one or more images of the applied adhesive medium 10. The obtained images are sent to a controller and/or processor, where they are analysed to detect presence, or absence, of the adhesive medium 10. The analysis may be conducted by measuring the extent and/or the location of the adhesive medium 10 and then comparing the measured values with a range of predetermined reference values. If the measured values are out of the predetermined reference values, then the pack is rejected. Alternatively, or in addition, the obtained images may be compared with a control or reference image. The images are obtained before the lid 6 is pivoted back to the closed position. Those packs P marked as defective are preferably rejected by the sorting mechanism after the lid 6 is pivoted back to the closed position.

Figure 4:
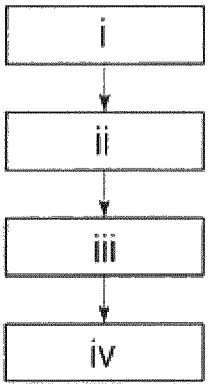
FIG. 4 is a flow diagram schematically illustrating steps in a method of producing a pack of smoking articles according to an embodiment.

Finally, with reference now to FIG. 4 of the drawings, a flow diagram is shown that schematically illustrates steps in a method of producing a pack of smoking articles according to a preferred embodiment of the invention as described above with respect to FIG. 2 and FIG. 3. In this regard, the first box i of FIG. 4 represents the step of providing a pre-assembled pack P of smoking articles, such as cigarettes, with the pack P comprising an inner pack 1 having a flexible sheet 2 in which a group of smoking articles C is wrapped or enclosed and a flap 3 movable between a closed position and an open position, and an outer pack 4 including a container body 5 which holds and substantially surrounds the inner pack 1, the outer pack 4 having a lid 6 in a closed position preventing access to the inner pack. The pre-assembled pack P is preferably provided in a lying orientation with a front panel F of the pack facing upwards and the lid 6 of the pack P at a forward end in a direction of travel.

The second box ii represents a step of creating a space or gap h, d between the lid 6 of the outer pack 4 and the inner pack 1. As noted above, this step may involve partially opening the lid 6 relative to the container body 5 of the outer pack.

The third box iii then represents the step of attaching the re-closable flap 3 of the inner pack 1 to the lid of the outer pack 4 via and/or through the space or gap h, d; for example, by introducing or inserting an adhesive medium 10 via the gap or space h, d. The attaching step may include relatively moving the lid 6 of the outer pack 4 back to the closed position, especially after introducing the attaching means, to press the adhesive medium 10 introduced or inserted via the gap or space h, d into contact with either or both an outer surface 11 of the re-closable flap 3 of the inner pack 1 and an inner surface 12 of the lid 6 of the outer pack.

The final box iv shown in FIG. 4 represents the optional steps of detecting an application of the adhesive medium 10 to the lid 6 of the outer pack 4 and/or to the flap 3 of the inner pack and rejecting the pack if application of the adhesive medium 10 is detected as having failed; for example, if no adhesive medium 10 is detected, or if an amount or location of the adhesive medium 10 detected is incorrect. These steps can be performed during or after the step of attaching the re-closable flap 3 of the inner pack 1 to the lid of the outer pack 4 via and/or through the space or gap h, d. Indeed, as previously explained, the detection step may be performed before relatively moving the lid 6 of the outer pack 4 back to the closed position to press the adhesive medium 10 introduced or inserted via the gap or space h, d into contact with either or both an outer surface 11 of the re-closable flap 3 of the inner pack 1 and an inner surface 12 of the lid 6 of the outer pack, while the rejection step may be performed after such relative movement.

After this, the method may include the step of transferring or transporting the completed pack P to a wrapping station to wrap the pack P individually in a clear film, such as cellophane, prior to final packing in a carton for dispatch to customers. Before wrapping the pack P, the method may include the step of transferring or transporting the completed pack P to a tax- or excise-stamp application station for applying a tax-stamp or excise-stamp as may be required by applicable regulations.

Figure 5:
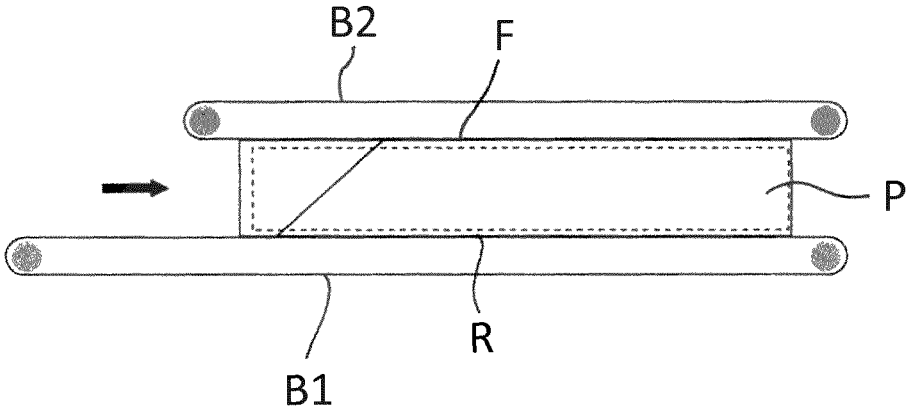
FIG. 5 is a schematic side view of a conveyor arrangement for transporting a completed pack towards a wrapping station according to a preferred embodiment.

FIG. 5 shows a preferred conveyor belt arrangement for transporting the pack P to the wrapping station once the lid 6 has been pivoted back to the closed position. This conveyor belt arrangement may be located upstream or downstream of the sorting mechanism to reject defective packs. Preferably, the conveyor belt arrangement is located between the sorting mechanism and the wrapping station.

In the preferred conveyor belt arrangement of FIG. 5, the completed pack P is transported by a first conveyor belt B1 that engages the rear panel R of the pack P along the direction indicated by the arrow. At a certain point, the front panel F of the pack P engages with a second conveyor belt B2. This results in a pressure being exerted against the lid 6, which is maintained while the rear and front panels R, F of the pack P are in contact with the first and second conveyors B1, B2. Therefore, by selecting the length and speed of the conveyor belts B1, B2, it is possible to establish the predetermined period of time during which pressure is applied to the lid 6. This has been found to be an efficient manner of applying pressure to the lid 6 as it reduces machine footprint.

Although specific embodiments of the invention have been illustrated and described herein, it will be appreciated by those of ordinary skill in the art that a variety of alternate and/or equivalent implementations exist. It should be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein. Any method step herein described may be performed while packs are in movement or at a standstill. The apparatus may be modified accordingly to perform the corresponding method steps while the packs are in movement or at a standstill.

In this document, the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

LIST OF REFERENCE SIGNS

1 inner pack
3 flexible sheet
3 re-closable flap
4 outer pack
5 container body
6 lid
7 hinge line
8 lower edge of lid
9 edge of container body
10 adhesive medium
11 outer surface of flap
12 inner surface of lid
P pack
C smoking article
F front panel
R rear panel
S side panel
h space or gap in plan view d space or gap in end view
B1 first conveyor belt
B2 second conveyor belt

The invention claimed is:

1. A method of producing a pack of smoking articles, comprising:

providing a pre-assembled pack of smoking articles comprising an inner pack comprising a flexible sheet in which a group of smoking articles is wrapped and having a re-closable flap movable between a closed flap position for preventing access to the smoking articles and an open flap position for accessing the smoking articles, and an outer pack comprising a container which holds and substantially encompasses the inner pack, the outer pack having a lid in a closed lid position preventing access to the inner pack, wherein the lid is movable between the closed lid position and an open lid position for accessing the inner pack;

subsequently, creating a space between the lid of the outer pack and the inner pack to provide access to a portion of the re-closable flap, wherein creating the space comprises pivoting the lid relative to the container, from the closed lid position to an at least partially open lid position;

attaching the re-closable flap of the inner pack to the lid of the outer pack via the space; and subsequently, transporting the pack to a wrapping station to wrap the pack individually in a clear film.

2. A method according to claim 1, further comprising introducing attaching means via the space for attaching the flap of the inner pack to the lid of the outer pack, wherein the attaching means is introduced into the space for contact with the flap of the inner pack and/or with the lid of the outer pack.

3. A method according to claim 2, wherein the step of introducing the attaching means comprises applying adhesive means onto the lid and/or onto the flap of the inner pack.

4. A method according to claim 3, wherein the adhesive means comprises at least one of: an adhesive element or strip; and an adhesive medium.

5. A method according to claim 4, wherein the adhesive medium is an adhesive in fluid state.

6. A method according to claim 3, wherein the adhesive means comprises at least one of: a drying adhesive, a pressure-sensitive adhesive, and a hot-melt adhesive.

7. A method according to claim 2, wherein the attaching step comprises bringing an inner surface of the lid and an outer surface the re-closable flap into direct contact with one another or indirect contact through the attaching means.

8. A method according to claim 1, wherein the space is created between an inner surface of the lid and an outer surface of the inner pack and measures less than or equal to 8 mm.

9. A method according to claim 1, wherein the lid is pivotally connected to the container of the outer pack, such that the lid is configured for pivoting between the closed lid position and the open lid position, wherein the step of relatively moving the lid from the closed lid position comprises relatively pivoting the lid with respect to the container through an angle (β) of less than or equal to 35°.

10. A method according to claim 1, further comprising:

relatively moving the lid of the outer pack back to the closed lid position after introducing the attaching means;

wherein the step of moving the lid of the outer pack back to the closed lid position presses the attaching means into contact with either or both an outer surface of the re-closable flap of the inner pack and an inner surface of the lid of the outer pack.

11. An apparatus for producing a pack of smoking articles using the method of claim 1, comprising:

a receiver configured to receive the pre-assembled pack of smoking articles, and an applicator configured to apply an adhesive means and attach the re-closable flap of the inner pack to the lid of the outer pack.

12. An apparatus according to claim 11, wherein the applicator is configured to introduce the adhesive means as an adhesive element or medium onto an outer surface of the flap of the inner pack and/or onto an inner surface of the lid of the outer pack via the space.

13. An apparatus according to claim 11, further comprising:

a sensor device for detecting an application of the means to the lid of the outer pack and/or to the flap of the inner pack; and a sorting mechanism for rejecting the pack if the application of the adhesive means is detected as having failed.

* * * * *